US006029854A

United States Patent [19]

Wissen

[11] Patent Number: 6,029,854

[45] Date of Patent: Feb. 29, 2000

[54] PORTABLE LIQUID DISPENSER

[76] Inventor: William T. Wissen, 6130 Hansford La., Sugar Land, Tex. 77479

[21] Appl. No.: 09/154,320

[22] Filed: Sep. 16, 1998

[51] Int. Cl.[7] ..... B67D 5/08

[52] U.S. Cl. ..... 222/63; 222/333

[58] Field of Search ..... 222/63, 55, 61, 222/529, 333, 383.1, 488

[56] References Cited

U.S. PATENT DOCUMENTS 4,456,149 6/1984 Sciortino ..... 222/63
5,224,625 7/1993 Holtier ..... 222/63
5,901,880 5/1999 Clarke ..... 222/333

*Primary Examiner*—Philippe Derakshani

[57] ABSTRACT

A portable liquid dispensing device for delivering drinking fluids for consumption. A rechargeable battery powered pump is selectively actuated and controlled on demand through a manual actuator, and in-line check valve, and a pressure switch. The pump is attached to a portable storage vessel. When actuated, the pump evacuates the liquid through the vessel wall and fills a pipe segment. An in-line check valve holds terminal fluid pressure in the pipe downstream of the pump, and a pressure switch detects the liquid pressure in such pipe section. Multiple tubing sections transport the liquid to one or more dispensing valves.

16 Claims, 2 Drawing Sheets

PORTABLE LIQUID DISPENSER

BACKGROUND OF THE INVENTION

The present invention relates to the field of portable liquid dispensers for distributing liquids such as water. More particularly, the invention relates to an improved portable liquid dispenser for distributing water and other liquids to multiple nozzles operated by one or more persons.

Liquid dispensers store water and other liquids for consumption by athletes, sports spectators, construction workers, festival participants, and others. Such liquids provide comfort and reduce the possibility of life threatening dehydration. Insulated coolers typically store liquids for distribution through a gravity fed valve. However, such coolers do not distribute liquids to multiple persons simultaneously and are often physically tilted to reach liquid accumulated at the cooler bottom.

Numerous storage containers have been developed to distribute liquids to one or more persons. U.S. Pat. No. 4,456,149 to Sciortino (1984) disclosed a pump for moving purified water from a five gallon container to a refrigerator ice maker. When a spigot was opened, a sensing mechanism detected the water pressure drop and activated the pump. A second pressure switch deactivated the pump when the water bottle was empty, and the pump was manually reset. U.S. Pat. No. 4,801,088 to Baker (1989) disclosed a pump driven portable sprayer powered with rechargeable batteries.

U.S. Pat. No. 5,154,317 to Roppolo (1992) disclosed a portable liquid dispenser having a hand truck for moving the system to different locations. A rechargeable battery was connected to an electric pump, and a pressure switch activated the pump when a valve was opened to reduce the line pressure. The disclosure by Roppolo specifically emphasized a disengageable stabilizer for stabilizing the position of the liquid container on the portable carrier.

In other liquid distribution systems, U.S. Pat. No. 5,224,625 to Holtier (1993) disclosed a spray device having a fluid reservoir, a pump, and a pressure operated switch. When the valve was not operated, the pressure operated switch deactivated the pump. U.S. Pat. No. 5,645,404 to Zelenak (1997) disclosed an electronic pump system attached to a fluid reservoir powered with an electrical power supply. An actuating device selectively operated the pump in response to manipulation of a dispensing tube in a specific orientation. U.S. Pat. No. 5,788,125 to Steiner et al. (1998) disclosed a mist spray nozzle for distributing spray mist and for serving drinking water. A pump handle operated the pump for distributing fluid from a container.

Such systems distribute liquid to a nozzle, however such systems do not efficiently distribute liquid through a nozzle in a battery powered system. If the pump runs continuously to provide liquid pressure, precious battery power is lost. Although certain systems use a pressure sensor to activate the pump each time the nozzle is operated, these systems waste battery power by unnecessarily cycling the pump motor. Accordingly, a need exists for an improved liquid distribution system capable of efficiently providing a consumable liquid through a nozzle. The system should preferably provide liquid simultaneously to more than one nozzle.

SUMMARY OF THE INVENTION

The present invention provides an improved apparatus for dispensing a potable liquid. The apparatus comprises a portable container for storing the liquid, a nozzle for releasing the liquid, and a pump engaged with the liquid for selectively discharging a pressurized liquid stream through a pump discharge. A manifold receives said pressurized liquid stream and distributes the pressurized liquid stream to at least one nozzle, and a check valve is engaged between the pump and the manifold for retaining the liquid pressure within the manifold above a selected pressure. The pump is selectively actuatable to discharge a pressurized liquid stream when the manifold liquid pressure downstream of the check valve is lowered below a selected level.

In different embodiments of the invention, multiple nozzles can dispense the liquid to more than one person, and the manifold can be configured to extend the nozzle reach to locations distant from the pump. A sensor can be attached directly to the manifold or can be integrated within the pump for detecting the liquid pressure within the manifold, or for controlling actuation of the pump.

DESCRIPTION OF THE PREFERRED EMBODIMENTS

The present invention provides an improved apparatus for dispensing liquids for consumption. Although the invention is useful with a single nozzle, the invention is particularly useful for multiple nozzles serving more than one person simultaneously.

Figure 1:
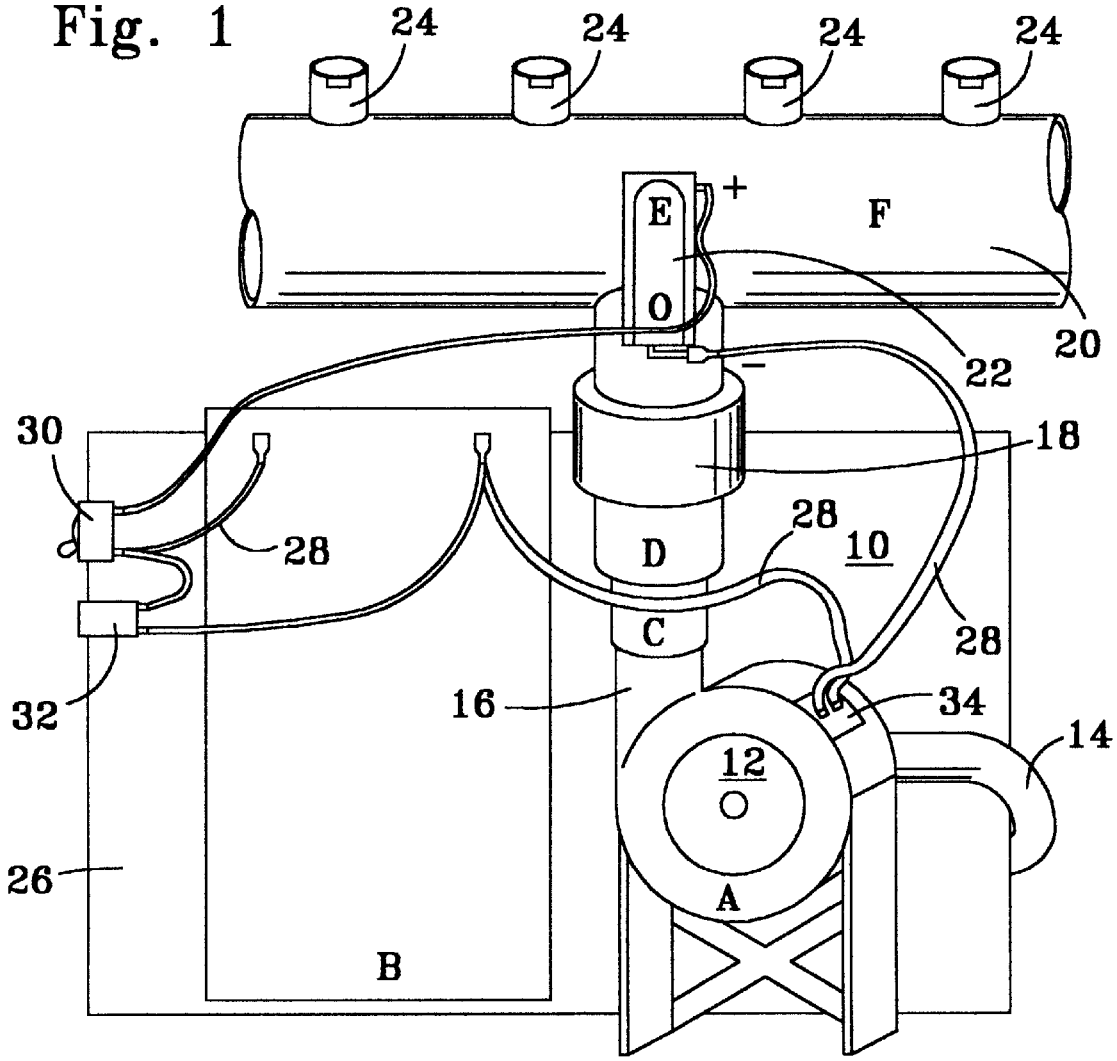
FIG. 1 illustrates an elevation view of one embodiment of a pump, check valve, and manifold for distributing potable liquid.

FIG. 1 illustrates an elevation view of one embodiment of the invention. Storage container 10 holds liquid (not shown) which can comprise water or other beverage suitable for consumption by one or more persons. Pump 12 is engaged with container 10 through intake hose 14 and selectively operates to discharge pressurized liquid stream through pump discharge 16. Check valve 18 is engaged with pump discharge 16, and selectively prevents backflow of the liquid toward pump 12. Manifold 20 is engaged with check valve 18, and pressure sensor 22 detects the liquid pressure within manifold 20.

Manifold 20 is attached to four discharge nozzles 24 for selectively and independently releasing liquid into the ambient environment. Nozzles 24 can discharge liquid for consumption or for other purposes. For example, nozzles 24 can discharge liquid in a mist spray for cooling overheated persons, for mixing different liquids into a single composite liquid, or for other purposes. The shape, liquid discharge rate and configuration, and operation of nozzles 24 can be designed for a particular use or application, and can be operated manually or with automated or semi-automated systems. Although four nozzles 24 are illustrated, the unique function provided by the invention is useful with a single nozzle 24 as more fully described below.

Battery 26 is connected with electrical wires 28 to on/off switch and with wires 28 to recharge outlet 32. Electrical wires 28 also connect battery 26 to pump motor 34 within pump 12, and connect pump motor 34 to sensor 22. Battery 26 is preferably rechargeable to permit reuse of battery 26 as a source of electrical power through repeated cycles. Although the system is operable with permanent power, the energy saving features of the invention are particularly beneficial with battery power because the invention efficiently draws energy only as required. Pump 12 is normally in a nonfunctioning mode and is not actuated until pressure sensor 22 detects a liquid pressure equal to or below a selected level. As a representative example, the pressure level for pressure sensor 22 can approximate eight psi, although higher or lower pressure values can be selected. When pressure sensor 22 functions in response to the selected liquid pressure level, pump 12 is actuated to provide a pressurized liquid discharge through check valve 18 and to manifold 20. When pressure sensor 22 detects a liquid pressure at a selected level over the actuation threshold pressure, pressure sensor 22 switches pump 12 off. The function of pressure sensor 22 can be integrated into pump 12 or into other elements to reduce the number of system components.

When pump 12 is actuated to produce a pressurized liquid discharge, such liquid passes through check valve 18 and into manifold 20. Check valve 18 can be mechanical or automated to perform different functions into addition to the primary function of preventing liquid backflow toward pump 12. By preventing such backflow, liquid pressure within manifold 20 is retained and liquid leakage past the seals and other components of pump 12 is avoided. When nozzle 24 or one of nozzles 24 is opened to dispense the liquid, pump 12 is actuated to recharge the pressure within manifold 20. Because check valve 18 holds the liquid pressure when a nozzle 24 is not being operated, pump 12 does not have to recharge this initial pressure level, thereby saving energy in the form of stored battery 26 power. Check valve 18 also provides the function of modulating the liquid pressure within manifold by reducing the operating pressure range. By holding the manifold liquid pressure at an elevated level, liquid pressure serving an open nozzle or nozzles 24 is initially retained within a selected discharge range, thereby avoiding the need for pump 12 to build-up such operating pressure.

This feature of the invention is also important in controlling the liquid discharge through each nozzle because such liquid pressure is not dependent upon cycles of pump 12 operation. The discharge through each nozzle 24 depends on the liquid pressure within manifold in addition to the design and construction of nozzle 24. By isolating pump 12 from direct pressure contact with nozzles 24, irregular discharge of liquid is diminished, and uniform liquid distribution is facilitated. This feature prevents a liquid discharge from fluctuating between a high pressure jet and a trickle in volume.

Figure 3:
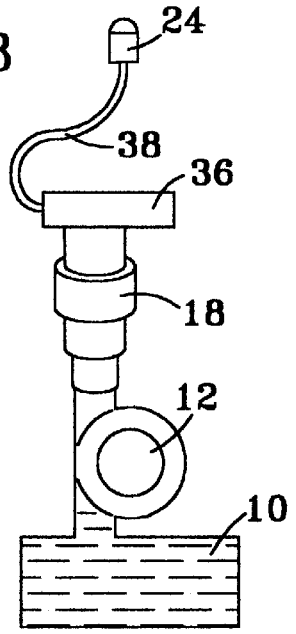
FIG. 3 illustrates a multiple nozzle system wherein the manifold has extended reach sections.
Figure 2:
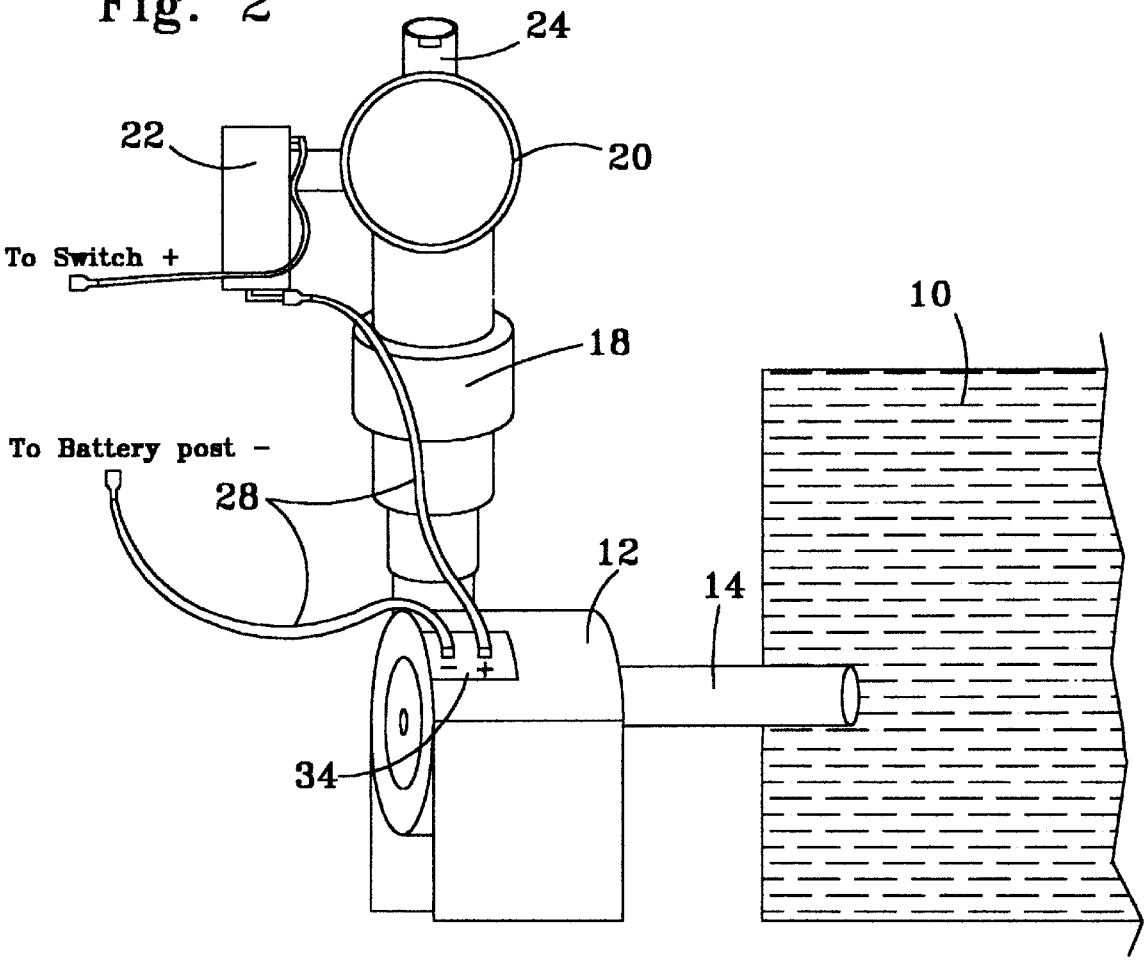
FIG. 2 illustrates a side elevation view of a pump intake and storage container.

FIG. 3 illustrates another embodiment of the invention wherein a single nozzle 24 is engaged with manifold 36. A portion of manifold 36, identified as tube section 38, extends the reach of nozzle 24 from pump 12. This embodiment of the invention permits distribution of liquid to locations distant from pump 12. In such embodiment, check valve 18 provides the additional function of reducing frictional tube pressure losses caused by the increased tubing length.

Other embodiments of the invention can be configured to provide a check valve in a potable liquid distribution system. The embodiments illustrated are easy to construct and provide reliable liquid distribution. In other embodiments, automated controls and additional sensors can selectively control the liquid pressure within manifold 20 within selected pressure ranges. By controlling the range of terminal liquid pressure prior to discharge, the invention precisely controls the distribution of liquid through one or more nozzles.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for dispensing a potable liquid, comprising:

a portable container for storing the liquid;

a nozzle for releasing the liquid;

a pump engaged with the liquid for selectively discharging a pressurized liquid stream through a pump discharge;

a manifold for receiving said pressurized liquid stream and for distributing said pressurized liquid stream to at least one nozzle;

a check valve engaged between said pump and said manifold for retaining the liquid pressure within said manifold above a selected pressure, wherein said pump is selectively actuatable to discharge a pressurized liquid stream when the manifold liquid pressure downstream of said check valve is lowered below a selected level.

2. An apparatus as recited in claim 1, further comprising at least two nozzles in liquid communication with said manifold.

3. An apparatus as recited in claim 1, further comprising a pressure sensor for detecting the liquid pressure within said manifold and for communicating a signal for actuating said pump.

4. An apparatus as recited in claim 1, wherein said pressure sensor comprises a switch for selectively activating and deactivating said pump.

5. An apparatus as recited in claim 1, wherein said nozzle is capable of discharging a single liquid stream.

6. An apparatus as recited in claim 1, wherein said nozzle is capable of discharging a liquid mist.

7. An apparatus as recited in claim 1, wherein said manifold includes an elongated section attached to said nozzle for permitting placement of said nozzle at a location distant from said pump.

8. An apparatus as recited in claim 1, further comprising a battery engaged with said pump for providing electric power to said pump.

9. An apparatus as recited in claim 8, wherein said battery is rechargeable.

10. An apparatus for dispensing a potable liquid, comprising:

a portable container having a closed interior for storing the liquid;

at least two nozzles for releasing the liquid;

a pump engaged with the liquid within said container interior for selectively discharging a pressurized liquid stream through a pump discharge;

a manifold for receiving said pressurized liquid stream and for distributing said pressurized liquid stream to said nozzles, wherein said manifold includes extensions for permitting placement of said nozzles at a location distant from said pump;

a check valve engaged between said pump and said manifold for retaining the liquid pressure within said manifold above a selected pressure, wherein said pump is selectively actuatable to discharge a pressurized liquid stream when the manifold liquid pressure downstream of said check valve is lowered below a selected level.

11. An apparatus as recited in claim 10, wherein said check valve is located upstream of said pump.

12. An apparatus as recited in claim 10, wherein said check valve is located within said manifold.

13. An apparatus as recited in claim 10, further comprising a pressure sensor for detecting the liquid pressure within said manifold and for communicating a signal for actuating said pump.

14. An apparatus as recited in claim 10, further comprising a battery engaged with said pump for providing electric power to said pump.

15. An apparatus as recited in claim 14, wherein said battery is rechargeable.

16. An apparatus as recited in claim 10, further comprising a sensor for detecting the liquid level within said container interior, wherein said sensor is capable of detecting when said liquid level reaches a selected level and is further capable of transmitting a signal for deactivating said pump.

* * * * *